US006946927B2

(12) United States Patent
Allen et al.

(10) Patent No.: US 6,946,927 B2
(45) Date of Patent: Sep. 20, 2005

(54) SUSPENDED SUBSTRATE LOW LOSS COUPLER

(75) Inventors: Barry Ross Allen, Rolling Hills Estates, CA (US); Daniel Kwok-hung Ko, Arcadia, CA (US); David Joseph Brunone, Rancho Palos Verdes, CA (US)

(73) Assignee: Northrup Grumman Corporation, Los Angeles, CA (US)

( * ) Notice: Subject to any disclaimer, the term of this patent is extended or adjusted under 35 U.S.C. 154(b) by 8 days.

(21) Appl. No.: 10/705,870

(22) Filed: Nov. 13, 2003

(65) Prior Publication Data

US 2005/0104681 A1 May 19, 2005

(51) Int. Cl.[7] ..... H01P 3/08
(52) U.S. Cl. ..... 333/116
(58) Field of Search ..... 333/115–117, 204, 333/238

(56) References Cited

U.S. PATENT DOCUMENTS 4,394,630 A * 7/1983 Kenyon et al. ..... 333/116
5,075,646 A * 12/1991 Morse ..... 333/116
5,243,305 A * 9/1993 D'Oro et al. ..... 333/116
6,822,532 B2 * 11/2004 Kane et al. ..... 333/116

* cited by examiner

*Primary Examiner*—Seungsook Ham
(74) *Attorney, Agent, or Firm*—Jones, Tullar & Cooper, P.C.

(57) ABSTRACT

A low loss suspended substrate coupler includes a substrate having a first transmission line disposed on a topside of the substrate and a second transmission line disposed on the bottom side of the substrate, thereby providing broadside transmission line coupling. To provide closer mode velocity matching, the coupler has capacitive loading or coupling to ground at discrete intervals between the two transmission lines. The capacitive loading is formed by integrating stubs in each transmission line at pre-determined intervals, each of which is opposite a corresponding one of a plurality of ground stubs on the other side of the substrate. The ground stubs are connected to ground at the outer edge of the coupler area with substrate vias or directly to the coupler housing.

14 Claims, 4 Drawing Sheets

SUSPENDED SUBSTRATE LOW LOSS COUPLER

BACKGROUND OF THE INVENTION

1. Field of the Invention

The present invention relates in general to a suspended substrate quadrature coupler for combining two receive or transmit amplifiers for increased power output, reduced port VSWR and improved reliability.

2. Description of the Background Art

There is a need for low cost, low insertion loss, high-power handling capability quadrature couplers that can be inserted into an integrated circuit module assembly (IMA). For receiver modules, insertion loss is critical to minimize the noise figure contribution between the antenna and the first low noise amplifier. Any coupler insertion loss will directly add to the overall noise figure of the receiver module. For transmitter modules, low-loss and high power handling is critical if the coupler follows the power amplifier. For transmit applications, the coupler may need to handle over one hundred watts of RF output signal from two power amplifiers. The coupler needs to be low loss so that maximum power is transferred from the power amplifier to the transmit antenna and to minimize the wasted transmit power heating the coupler.

Prior art microwave couplers include microstrip Lange couplers, waveguide couplers and stripline couplers. Low insertion loss Lange couplers require precision lithography to maintain close spacing between coupler fingers. These tight spacing requirements are difficult to achieve in low cost printed circuit processes. In addition, Lange couplers require thick substrates for low loss and to increase the line-to-line spacing needed for a 3 dB quadrature coupler. Lange couplers are also not suited for low cost printed circuit implementation because of the need for crossovers to interconnect the alternate fingers. Waveguide couplers can handle high power RF signals with low loss but are very large at cell phone frequencies and are not suitable for integration with active devices.

Stripline couplers are the most common approach for quadrature 3 dB couplers at cell phone frequencies because of the well matched even and odd mode coupled transmission line impedance. These couplers require multilayer printed circuit fabrication techniques. The dielectric loss of the circuit board material is critical for low loss stripline couplers because all of the electric field energy is stored in the dielectric material. Suspended stripline couplers can be fabricated as a single layer printed circuit board but normally have the disadvantage of very different even and odd mode velocity in coupled transmission line structures. The electric field energy is stored mostly in air for the even mode while there is more electric field energy stored in the dielectric material for the odd mode, thus slowing the odd mode velocity relative to the even mode. The difference in coupled line phase velocity causes generally poor performance for simple suspended stripline couplers. Thus, there is a need for an improved suspended stripline coupler that provides closer mode velocity matching and improved coupler performance.

SUMMARY OF THE INVENTION

The present invention addresses the foregoing need through provision of a low loss suspended substrate coupler which includes a dielectric substrate, a first conductor metallization forming a first transmission line on a topside of the substrate and a second conductor metallization forming a second transmission line on the bottom side of the substrate. To provide closer mode velocity matching, a key feature of the coupler is the provision of capacitive loading or coupling to ground at discrete intervals between the transmission line on the topside of the substrate and the transmission line on the bottom side of the substrate. This capacitive loading is formed by incorporating capacitance stubs in each transmission line section at pre-selected intervals, each of which is opposite a corresponding one of a plurality of grounded stubs on the other side of the substrate. This capacitive loading to ground at discrete intervals along the transmission line represents a low cost method for providing closer even to odd mode velocity matching across a given frequency bandwidth, corresponding to improved isolation and lower VSWR.

Preferably, to improve performance, the coupler design also uses substrate vias to provide microstrip interfaces and microstrip matching elements on one side of the substrate for the coupler ports at both ends of each coupled transmission line. In addition, the substrate coupler is preferably mounted in an enclosure with controlled spacing to ground above and below the substrate to control the transmission line impedance of the coupled lines and to provide shielding of the coupler.

BRIEF DESCRIPTION OF THE DRAWINGS

The features and advantages of the present invention will become apparent from the following detailed description of a preferred embodiment thereof, taken in conjunction with the accompanying drawings, in which.

DETAILED DESCRIPTION OF THE PREFERRED EMBODIMENT

Figure 1:
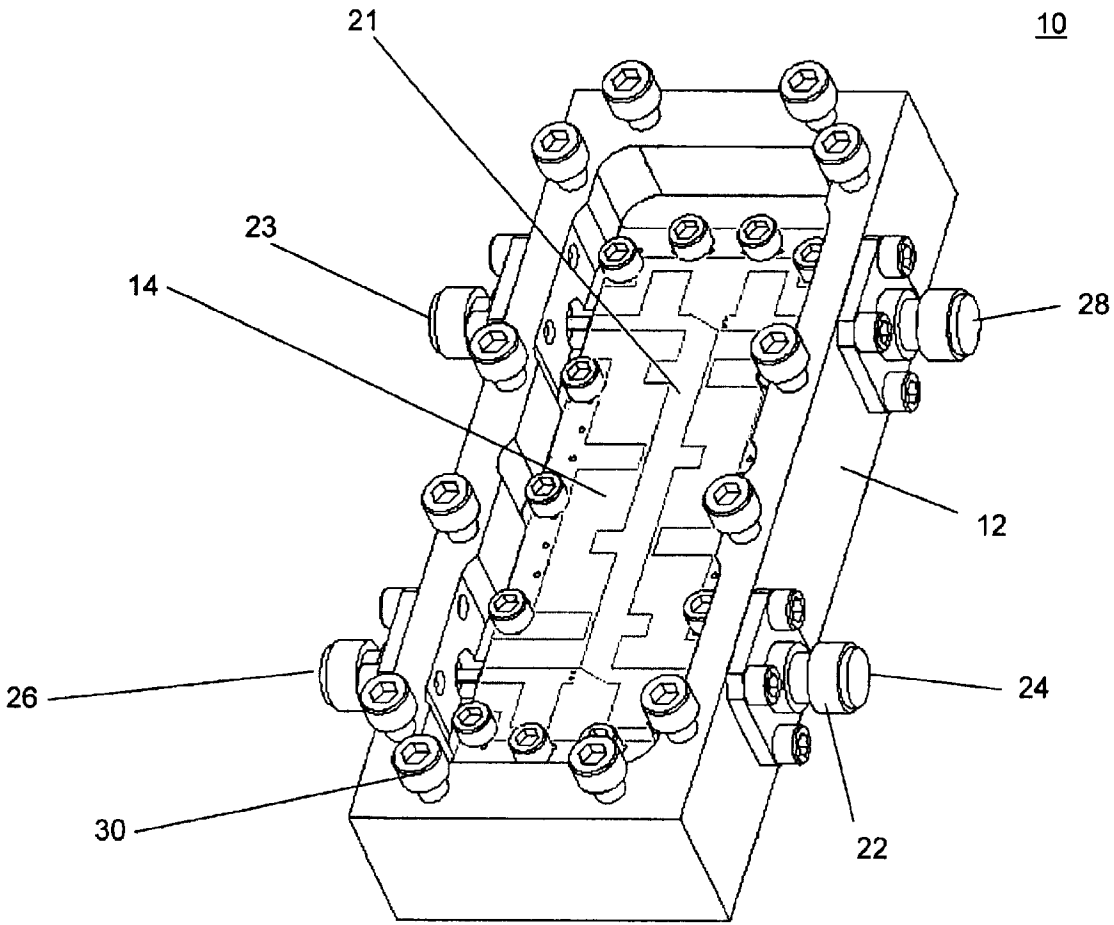
FIG. 1 is a perspective illustration of a suspended substrate coupler that is constructed in accordance with the preferred embodiment of the present invention.

FIG. 1 illustrates a suspended substrate quadrature coupler 10 that is constructed in accordance with the preferred embodiment of the invention. The coupler 10 includes a housing 12, which is preferably made form metal, metal coated plastic or any other suitable electrically conductive material and includes a removable cover 13. Disposed in the housing 12 is a dielectric substrate 14.

Figure 2:
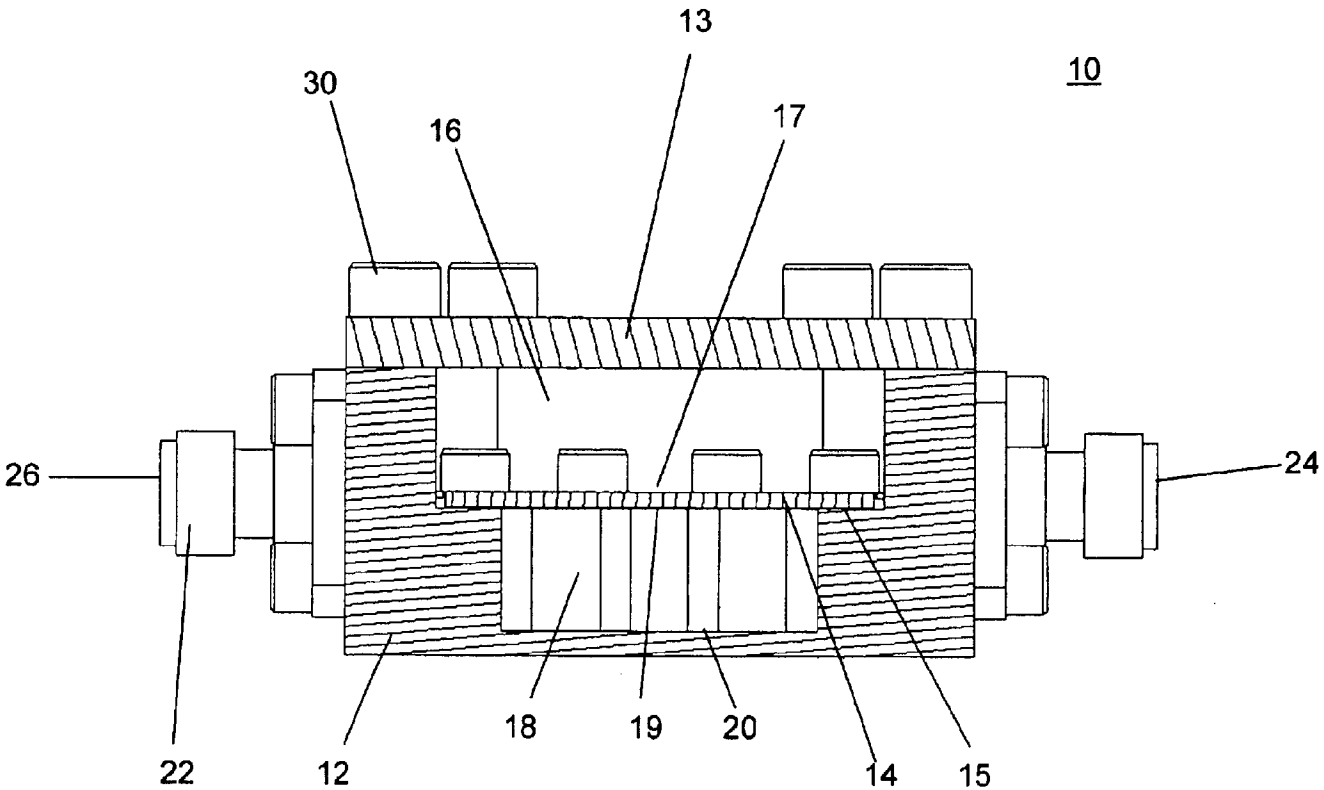
FIG. 2 is front view of the coupler of FIG. 1 shown in cross section.

As illustrated in FIG. 2, the substrate 14 is mounted on a ledge 15 of the housing 12 in a suspended manner such that a first cavity 16 is formed between a topside 17 of the substrate 14 and the cover 13, while a second cavity 18 is formed between a bottom side 19 of the substrate 14 and a floor 20 of the housing 12. A transmission line coupler circuit 21 is formed on both the top and bottom sides of the substrate 14 as will be discussed in detail in conjunction with FIGS. 3A and 3B. The mounting of the substrate 14 in the housing 12 with controlled spacing to ground above and below the substrate 14 controls the transmission line impedance of the coupler circuit 21. In addition, the housing 12 provides shielding of the coupler circuit 21.

As is conventional in a quadrature coupler, a plurality of connectors 22 is attached to the housing 12 for facilitating connection of various electrical components to a group of 4 ports including an input port 23, a direct output port 24, an isolation port 26 and a coupled output port 28. The various components of the coupler 10 are secured together using any suitable fastening means such as a plurality of bolts 30.

Figure 3A:
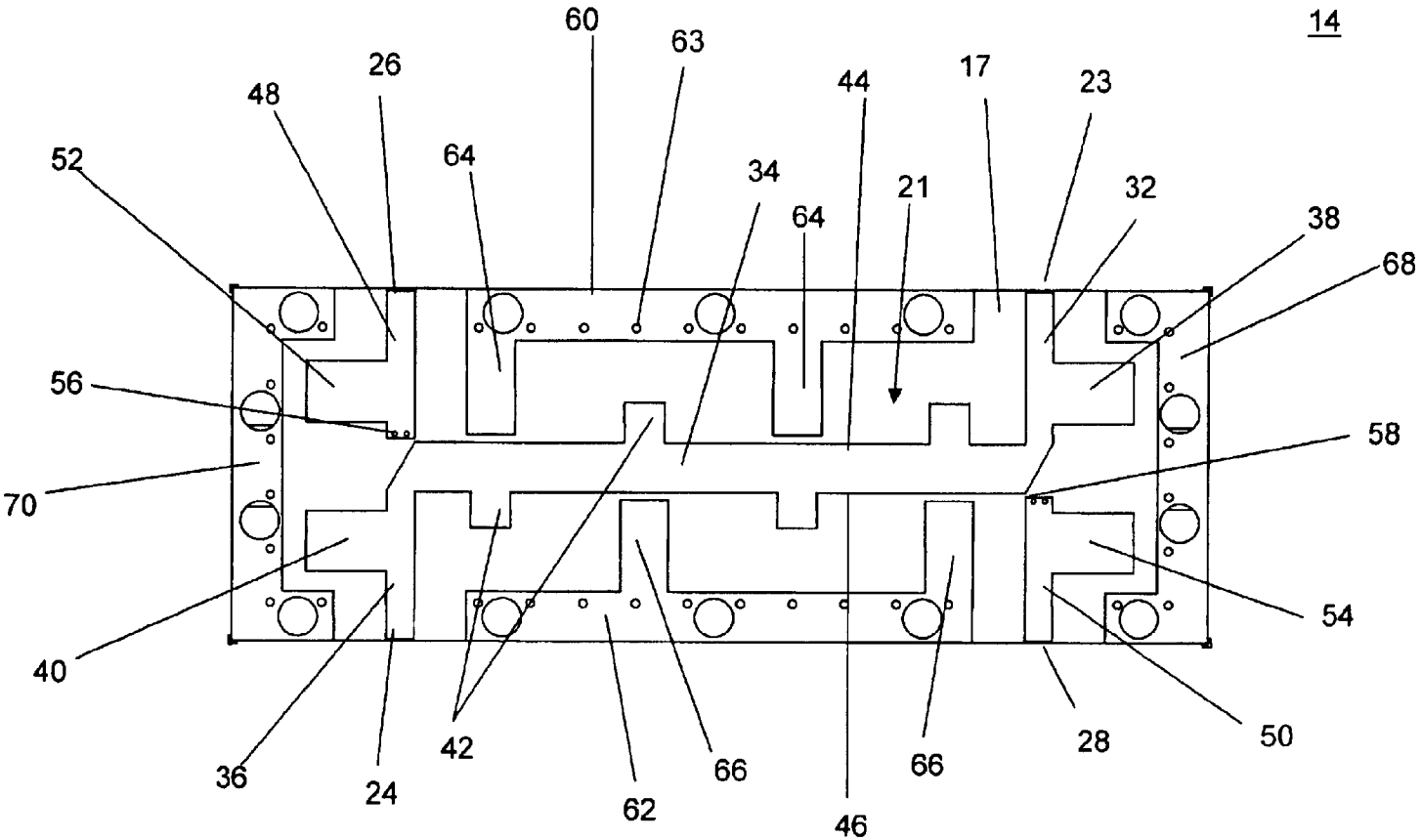
FIG. 3A is a top view of the suspended substrate employed in the coupler of FIG. 1 and showing the transmission line configuration formed thereon.
Figure 3B:
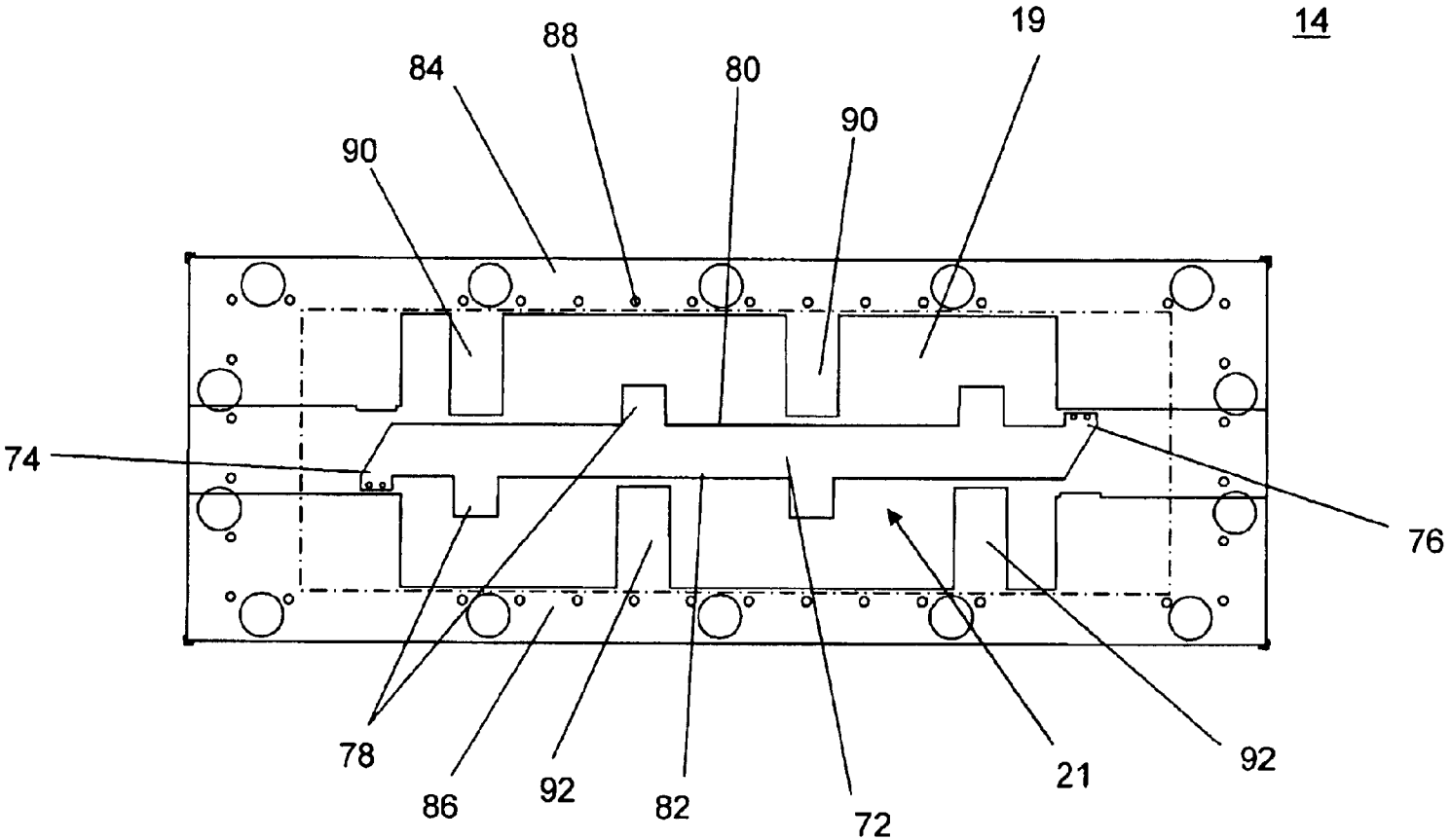
FIG. 3B is a bottom view of the suspended substrate, also showing the transmission line configuration formed thereon.

FIGS. 3A and 3B illustrate the details of the transmission line coupler circuit 21 that is formed on the top and bottom sides 17 and 19 of the suspended substrate 14. In FIG. 3A, a top view of the substrate 14 is shown in which the transmission line coupler circuit 21 comprises a plurality of various shaped conductor lines or metallizations disposed on the topside 17 of the substrate 14. The largest of these is a transmission line metallization which includes a first microstrip interface 32 for connecting the input port 23 to a first end of a transmission line 34 and a second microstrip interface 36 for connecting a second end of the transmission line 34 to the direct output port 24. Adjacent each of the microstrip interfaces 32 and 36 is a matching stub 38 and 40, respectively. Four capacitive stubs 42 are spaced at predetermined intervals along the transmission line 34. As illustrated, the stubs 42 extend in alternating directions first from one side 44 of the transmission line 34 and then from an opposite side 46 of the transmission line 34.

First and second microstrip interfaces 48 and 50 are provided for interfacing a bottom transmission line (to be discussed later in conjunction with FIG. 3B) of the coupler 10 at a first end to the isolation port 26 and at a second end to the coupled output port 28, respectively. Each of the interfaces 48 and 50 includes a corresponding one of third and fourth matching stubs 52 and 54, as well as a corresponding one of first and second terminals 56 and 58. The terminals 56 and 58 connect the interfaces 48 and 50, respectively, to one or more conductive pass-throughs or vias in the substrate 14 that connect to the transmission line coupler circuit 21 on the bottom side 19 of the substrate 14 as illustrated in and discussed in conjunction with FIG. 3B.

First and second ground metallizations 60 and 62 are also disposed on the topside 17 of the substrate 14, each of which is grounded along their outer edges either to a plurality of substrate vias 63 or directly to the housing 12 when assembled thereto. A first pair of ground stubs 64 is provided in the first ground metallization 60, while a second pair of ground stubs 66 is provided in the second ground metallization 62. As illustrated, each of the ground stubs 64 and 66 extends almost into contact with the transmission line 34 and is positioned directly across the transmission line 34 from a corresponding one of the capacitance stubs 42. Third and fourth ground metallizations 68 and 70 are also disposed along opposite ends of the substrate 14, which provide a ground reference adjacent each of the various matching stubs 38, 40, 52 and 54.

With reference to FIG. 3B, the transmission line coupler circuit 21 on the bottom side 19 of the substrate 14 comprises a second transmission line 72, which includes first and second terminals 74 and 76 that connect to the same pass-through connections or vias to which the terminals 56 and 58, respectively, on the topside 17 of the substrate 14 are connected. Four capacitive stubs 78 are spaced at predetermined intervals along the transmission line 72. As illustrated, the stubs 78 extend in alternating directions first from one side 80 of the transmission line 72 and then from an opposite side 82 of the transmission line 72.

First and second ground metallizations 84 and 86 are also disposed on the bottom side 19 of the substrate 14, each of which is grounded to a plurality of substrate vias 88 or to the housing 12 when assembled thereto. A first pair of ground stubs 90 is provided in the first ground metallization 84, while a second pair of ground stubs 92 is provided in the second ground metallization 86. As illustrated, each of the ground stubs 90 and 92 extends almost into contact with the transmission line 72 and is positioned directly across the transmission line 72 from a corresponding one of the capacitance stubs 78.

With the foregoing arrangement, broadside transmission line coupling is provided between the first transmission line 34 on the topside 17 of the substrate 14 and the second transmission line 72 on the bottom side 19 of the substrate 14. Additional capacitive coupling is provided to ground for the two transmission lines 34 and 72. In particular, the capacitance stubs 42 disposed along the first transmission line 34 are each coupled to ground by the corresponding ground stubs 90 and 92 on the bottom side 19 of the substrate 14 that are aligned beneath the capacitance stubs 42. Similarly, the capacitance stubs 78 disposed along the second transmission line 72 are each coupled to ground by the corresponding ground stubs 64 and 66 on the top side 17 of the substrate 14 that are aligned above the capacitance stubs 78. In this manner, each capacitance stub/ground stub pair thus forms a coupling capacitor between ground and either of the two transmission lines 34 or 72. This capacitive loading to ground at discrete intervals along the transmission lines provides closer even to odd mode velocity matching across a given frequency bandwidth, corresponding to improved isolation and lower VSWR.

Performance of the coupler 10 is further enhanced through provision of the elements at both ends of each coupled line 34 and 72, which are the microstrip interfaces 32, 36, 48 and 50 and microstrip matching elements 38, 40, 52 and 54 for each of the four coupler ports 23, 24, 26 and 28, respectively. The coupler 10 thus provides a very low cost method to equalize the even and the odd mode velocity of a suspended substrate coupler and when employed in receivers or transmitters, provides lower noise figure LNA receiver front ends and lower loss power transmitter sources.

Although the invention has been disclosed in terms of a preferred embodiment, it will be understood that numerous variations and modifications could be made thereto without departing from the scope of the invention as set forth in the attached claims. For example, although the preferred embodiment of the subject coupler is a four-port quadrature coupler, the invention could be employed with any type of suspended substrate coupler having transmission line sections that can be capacitvely coupled to improve performance.

What is claimed is:

1. A suspended substrate coupler comprising:

a housing;

a dielectric substrate suspended in said housing, said substrate having a topside and a bottom side;

a first transmission line disposed on said topside of said substrate;

a second transmission line disposed on said bottom side of said substrate;

a first plurality of spaced stubs disposed along and extending from first and second sides of said first transmission line;

a second plurality of spaced stubs disposed along and extending from first and second sides of said second transmission line;

a first plurality of grounded stubs disposed on said bottom side of said substrate, each of said grounded stubs being aligned with a corresponding one of said spaced stubs in said first transmission line on said topside of said substrate, whereby said first plurality of spaced stubs and said first plurality of said grounded stubs form a first plurality of coupling capacitors for said first transmission line; and a second plurality of grounded stubs disposed on said topside of said substrate, each of said grounded stubs being aligned with a corresponding one of said spaced stubs in said second transmission line on said bottom side of said substrate, whereby said second plurality of spaced stubs and said second plurality of said grounded stubs form a second plurality of coupling capacitors for said second transmission line, said first and second plurality of coupling capacitors serving to improve mode velocity matching in said coupler.

2. The coupler of claim 1, wherein said housing is electrically conductive and each of said ground stubs is electrically grounded to said housing.

3. The coupler of claim 1, wherein said housing includes a floor and a top cover and said substrate is mounted on a ledge in said housing such that a first cavity is formed between said topside of said substrate and said cover, and a second cavity is formed between said bottom side of said substrate and said floor of said housing.

4. The coupler of claim 1, further including an input port and an output port with said first transmission line being connected to said ports with first and second microstrip interfaces, respectively, each of said interfaces being disposed on said topside of said substrate.

5. The coupler of claim 4, wherein said first and second microstrip interfaces and said first transmission line are incorporated in a single metallization disposed on said topside of said substrate.

6. The coupler of claim 4, further including an isolation port and a coupled output port connected to said second transmission line.

7. The coupler of claim 6, wherein said second transmission line is connected to said isolation port and said coupled output port with third and fourth microstrip interfaces, respectively, each of said interfaces being disposed on said topside of said substrate; and, first and second conductive vias in said substrate, respectively, that connect the top side of said substrate to the bottom side of said substrate.

8. The coupler of claim 7, wherein each of said microstrip interfaces further includes a matching stub.

9. A suspended substrate coupler comprising:

an electrically conductive housing, said housing including a floor and a top cover;

a dielectric substrate having a topside and a bottom side, said substrate being mounted on a ledge in said housing such that a first cavity is formed between said topside of said substrate and said cover, and a second cavity is formed between said bottom side of said substrate and said floor of said housing;

a first transmission line disposed on said topside of said substrate, said first transmission line including a first plurality of spaced stubs disposed along and extending from first and second sides of said first transmission line section;

a second transmission line disposed on said bottom side of said substrate, said second transmission line including a second plurality of spaced stubs disposed along and extending from first and second sides of said second transmission line;

a first plurality of grounded stubs disposed on said bottom side of said substrate, each of said grounded stubs being aligned with a corresponding one of said spaced stubs in said first transmission line on said topside of said substrate, whereby said first plurality of spaced stubs and said first plurality of said grounded stubs form a first plurality of coupling capacitors for said first transmission line; and a second plurality of grounded stubs disposed on said topside of said substrate, each of said grounded stubs being aligned with a corresponding one of said spaced stubs in said second transmission line on said bottom side of said substrate, whereby said second plurality of spaced stubs and said second plurality of said grounded stubs form a second plurality of coupling capacitors for said second transmission line.

10. The coupler of claim 9, further including an input port and an output port with said first transmission line being interfaced to said ports with first and second microstrip interfaces, respectively, each of said interfaces being disposed on said topside of said substrate.

11. The coupler of claim 10, wherein said first and second microstrip interfaces and said first transmission line are incorporated in a single metallization disposed on said topside of said substrate.

12. The coupler of claim 10, further including an isolation port and a coupled output port connected to said second transmission line section.

13. The coupler of claim 12, wherein said second transmission line is connected to said isolation port and said coupled output port with third and fourth microstrip interfaces, respectively, each of said interfaces being disposed on said topside of said substrate; and, first and second conductive vias in said substrate, respectively, that connect the top side of said substrate to the bottom side of said substrate.

14. The coupler of claim 13, wherein each of said microstrip interfaces further includes a matching stub.

* * * * *